United States Patent [19]

Eriksson

[11] Patent Number: 4,571,146

[45] Date of Patent: Feb. 18, 1986

[54] DIGGING APPARATUS APPLICABLE TO A BUCKET LOADER

[76] Inventor: Ingemar Eriksson, Pl. 1166, Sjövik, Sweden, 440 07

[21] Appl. No.: 577,621

[22] PCT Filed: Jun. 3, 1983

[86] PCT No.: PCT/SE83/00224

§ 371 Date: Jan. 25, 1984

§ 102(e) Date: Jan. 25, 1984

[87] PCT Pub. No.: WO83/04277

PCT Pub. Date: Dec. 8, 1983

[30] Foreign Application Priority Data

Jun. 4, 1982 [SE] Sweden ..... 8203459

[51] Int. Cl.[4] ..... B66C 23/00; E02F 3/76

[52] U.S. Cl. ..... 414/687; 414/695.5; 414/723; 37/117.5

[58] Field of Search ..... 414/718, 687, 695.5, 414/723, 694; 137/117.5

[56] References Cited

U.S. PATENT DOCUMENTS

| | | | |
|---|---|---|---|
| 3,732,996 | 5/1973 | Bauer . | |
| 3,802,586 | 4/1974 | Lofgreen | 414/722 |
| 4,264,265 | 4/1981 | Stoychoff | 414/718 |
| 4,274,213 | 6/1981 | Yadlowsky | 37/117.5 |

FOREIGN PATENT DOCUMENTS

| | | |
|---|---|---|
| 2315581 | 6/1974 | Fed. Rep. of Germany . |
| 1496704 | 12/1977 | United Kingdom . |

*Primary Examiner*—William E. Wayner

*Attorney, Agent, or Firm*—Holman & Stern

[57] ABSTRACT

A digging apparatus (5) attachable to a bucket loader e.g. a tractor loader (1) of the type used for smaller digging work, such as excavating trenches, e.g. in agriculture, park management or the like, and incorporating a connecting device (4), intended to be connected to said bucket loader and with a pivot axle (8) connected thereto and extending mainly perpendicularly to the extension of the digging beam, a digging beam (11) pivotably supported about the pivot axle and having an overhead stay bar (13) and a bucket (17) attached to the free end of the digging beam, which bucket is operable by means of a driving device (15), and having at least one hydraulic piston (20) adapted to bring about the pivoting of the digging beam about the pivot axle and arranged to transfer pivot force to the digging beam at a short distance from the pivot axle, and wherein the digging beam (11) and the stay bar (13) are both designed as telescopic tubular profiles (11*a*, 11*b* and 13*a*, 13*b* resp.), which are individually adjustable in length by aid of individually operable attachment members (18), in order easily to adapt the apparatus for attachment to different bucket loaders and for rapid adjustment of the geometry of the digging beam in relation to varying digging conditions and positions.

4 Claims, 6 Drawing Figures

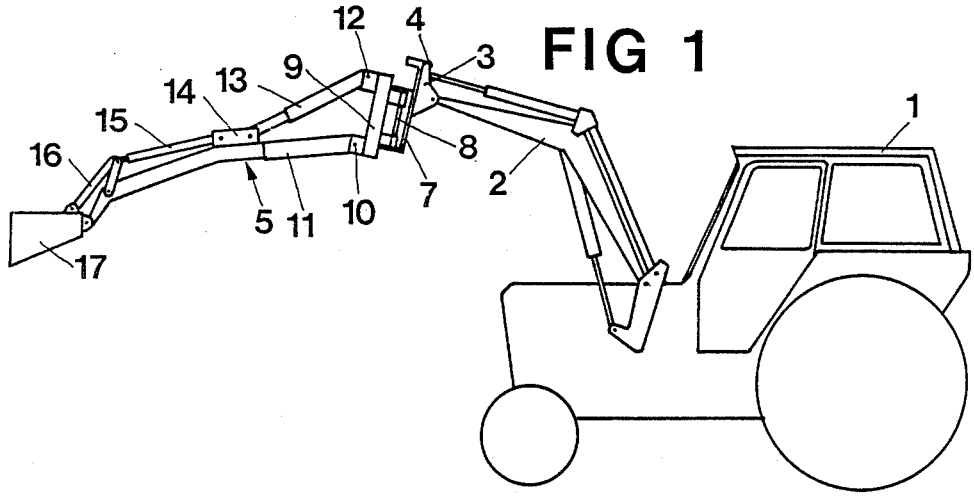
FIG 1
FIG 2
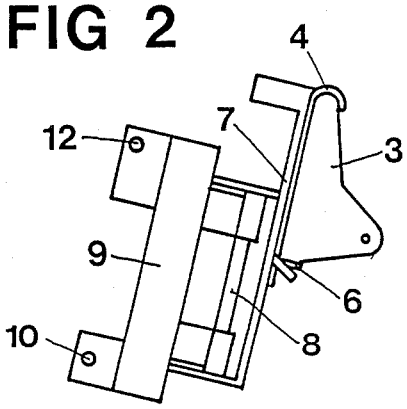
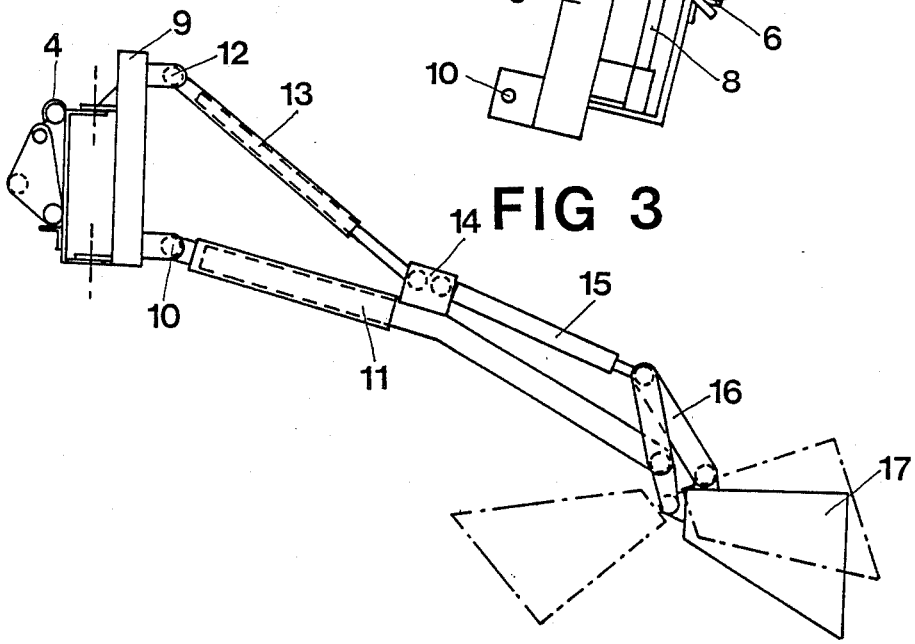
FIG 3

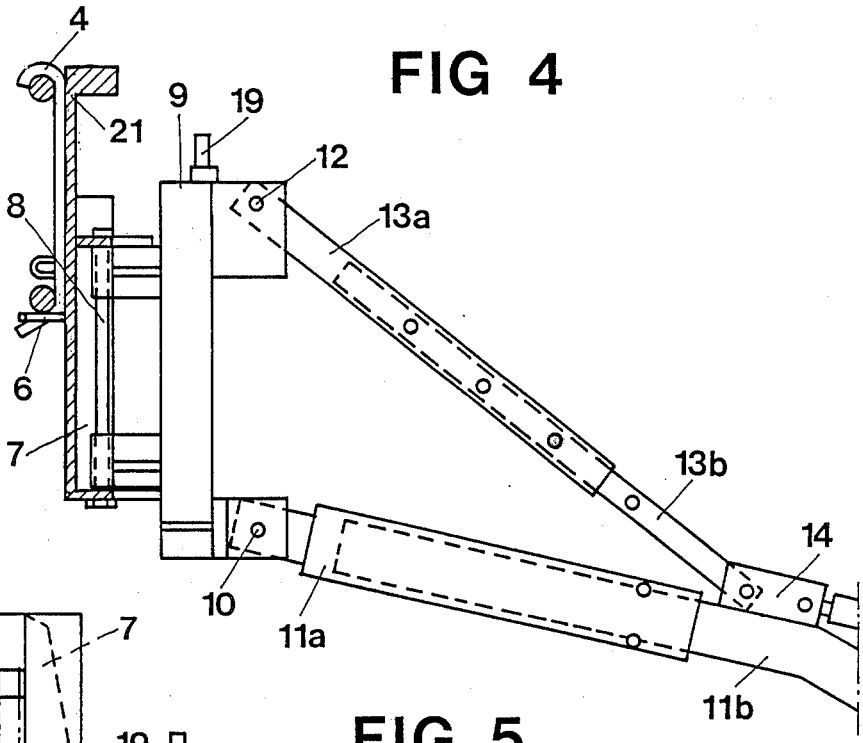
FIG 4
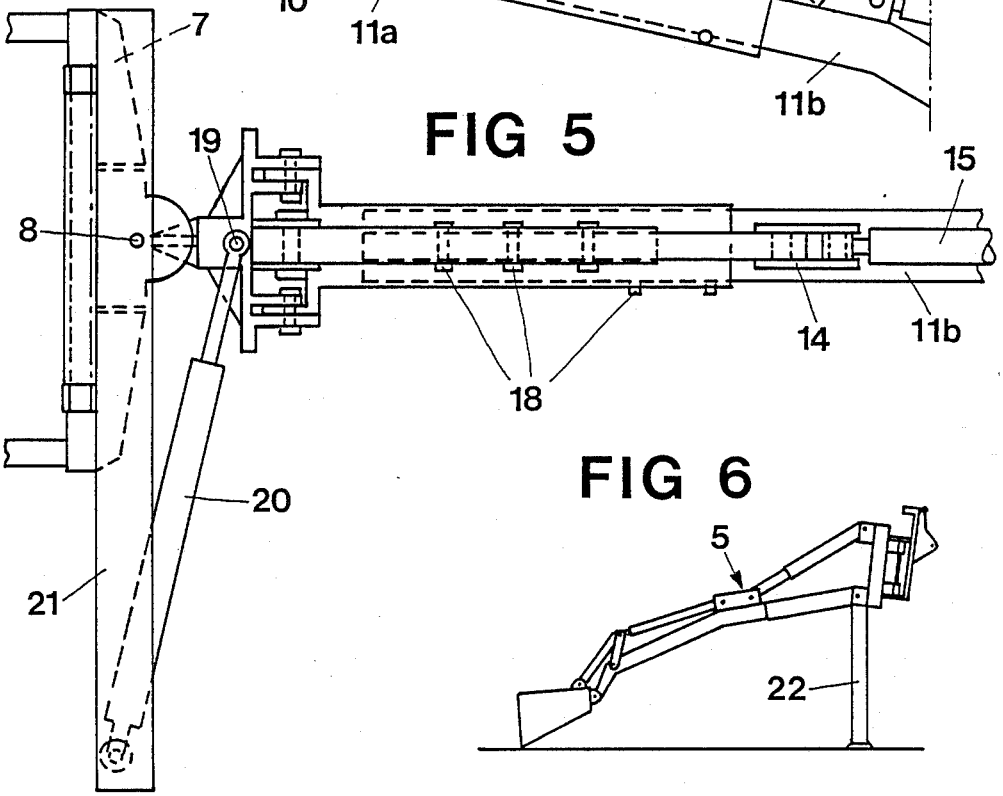
FIG 5
FIG 6

DIGGING APPARATUS APPLICABLE TO A BUCKET LOADER

CROSS REFERENCE TO RELATED APPLICATION(S)

This U.S. application stems from PCT International Application No. PCT/SE83/00224 filed June 3, 1983.

BACKGROUND OF THE INVENTION

The present invention refers to a digging apparatus applicable to a bucket loader, e.g. a tractor loader and of the type used for smaller digging work, such as trenching and e.g. in agriculture, park management or the like.

Such an apparatus must be so easy to mount on the loader that mounting and dismounting can be accomplished in short time and by a single machine operator. The apparatus should furthermore be light and flexible at the same time as it has great working range and mobility. It is of course also desirable that the apparatus is inexpensive and wear resistant.

Older apparatuses of this kind have commonly fulfilled only one or some of these requirements, whereas all requirements have to be fulfilled for making an apparatus, which is useful under intended conditions, which does not occupy the loader for unnecessary long time, and which is simultaneously flexible, robust and inexpensive.

Apparatuses of this type have lately been disigned, which incorporate a connecting device intended to be attached to said bucket loader and with a pivot axle connected thereto and extending mainly perpendicularly to the extension of the digging beam, which is pivotably supported about the pivot axle and has an overhead stay bar and a bucket attached to the free end thereof, which bucket is operable via a driving device, and having at least one hydraulic piston adapted to bring about the swinging of the digging beam about the pivot axle and arranged to transfer pivot force to the digging beam at a short distance from the pivot axle, and these apparatuses have fulfilled several of the above requirements.

A drawback with these known devices is that they have very rigid and unflexible digging beams and it is therefore commonly possible to apply them at one type of loader only, at the same time as the digging beam in practise lacks ability of adaption to different digging conditions and positions.

THE PURPOSE AND MOST ESSENTIAL FEATURES OF THE INVENTION

The purpose of the invention is now to provide a digging apparatus having high flexibility and therefore being applicable to different loaders and which fulfills all above defined requirements and this has been achieved thereby that the apparatus has been given the features appearing in the accompanying claim 1.

DESCRIPTION OF THE DRAWINGS

The invention will hereinafter be further described with reference to embodiments shown in the accompanying drawings.

FIG. 1 shows in a schematic side elevation a tractor loader with a digging apparatus according to the invention fitted thereto and shown in a forward extending position.

FIG. 2 is an enlarged side view of a detail of the connection between the loader arm of the bucket loader and the digging apparatus according to the invention.

FIG. 3 shows the separate digging apparatus according to the invention in a side view.

FIG. 4 shows in bigger scale a preferred embodiment of the rear portion of the digging apparatus according to the invention in a view from one side thereof.

FIG. 5 is a view from above of the portion av the digging apparatus shown in FIG. 4, and FIG. 6 shows the digging apparatus according to the invention in separate position.

DESCRIPTION OF PREFERRED EMBODIMENTS

In FIG. 1 is schematically shown a tractor loader 1 with a loader arm 2, which at its outer end is provided with connecting members 3 for interconnection with quick coupling brackets 4 attached to one end of a digging apparatus 5 according to the invention. It should be noted that the tractor loader can be substituted for every other suitable bucket loader provided with a corresponding, arbitrarily positioned loader arm.

The digging apparatus 5 is thus connected to the bucket loader in question via an easily operable quick coupling of known type, which has however been supplemented with stabilizing shoulders, shown at 6 in FIG. 2, and with other reinforcing means of proper type. When the coupling member 3 is driven against the quick coupling brackets 4 and is lifted the digging apparatus attached thereto will automatically be positioned in correct position whereupon it is necessary to secure the coupling with two not shown lockable pins only.

The digging apparatus 5 itself incorporates a plate 7 fitted to the quick coupling brackets and provided with brackets, which support a vertical pivot axle 8. On this vertical pivot axle 8 is pivotably supported a bracket 9, which in turn supports a digging beam 11 articulated on a first horizontal axle 10, and a stay bar 13 which is articulated about a second horizontal axle 12 situated at a higher level, the opposite end of said stay bar being pivotably connected to an attachment 14, arranged on the digging beam at a distance from the digging beam support 10. In this attachment 14 there is also fitted one end of a hydraulic piston 15, adapted with its other end to act upon a link 16, which transfers movement to a bucket 17 pivotably supported at the outer end of the digging beam. Transfer of the movement to the bucket is not critical for the invention but different conventional methods can be utilized.

FIG. 3 shows more in detail how the digging beam 11 as well as the stay bar 13 are both telescopically adjustable and both units may consist of square tubes or round profiles, which are preferably equipped with cooperating guiding members, e.g. guiding shoulders arranged in one of the tubes and engaging the other tube, or by means of profiles with forks or the like, welded thereto.

Due to this adjustability is it possible so set not only the length of the digging beam in relation to present digging work, but it is also possible to adjust the work range of the digging beam i.a. for bigger digging depths. This condition is furthermore improved by the fact that the outer end of the digging beam 11 is bent downwards about 15 degrees, which means that bigger digging movements can be achieved with unaltered digging beam length.

In FIGS. 4 and 5 are shown in schematic side and top views in larger scale, digging apparatus components such as connecting members, pivot axles, the upper part of the digging beam and the stay bar, and the figure intimates a preferred solution of the adjustability of the digging beam and the stay bar respectively, whereby the two portions of the digging beam 11*a*, 11*b* and of the stay bar 13*a*,13*b* respectively project into each other telescopically and are lockable in carefully defined mutual positions, by means of bolts 18. This shown solution is however only one of several possible embodiments, whereby it is possible instead to have a stepless adjustability by providing the two telescopingly cooperating profiles with cooperating threads, or with external adjustment members of different types.

In FIG. 4 is shown at the upper side of the bracket 9 an axle journal 19. This axle journal 19 is intended to cooperate with a hydraulic piston 20, which at its opposite end is attached to a horizontal profile 21 situated above the plate 7, which profile projects perpendicularly from the digging beam. As the hydraulic piston 20 thus can be located in such a manner that its power acts upon the bracket 9 in a point 19 situated very near its pivot axle 8, it is possible to achieve a very big pivot movement. Due to the fact that the pivot axle 8 furthermore is situated at a distance from the plate 7 and the hydraulic piston 20 is situated above the pivot axle 8 but below the upper profile 21, this big pivot movement will not be hampered by these components.

The shown solution of the driving of the digging beam pivoting about the vertical pivot axle 8 is likewise only one of several possible embodiments, whereby the essential is that the point of attack of the hydraulic piston is near to the vertical pivot axle of the digging beam. It is thus within the scope of the invention possible to provide the profile 21 with a bracket, which projects in the digging beam direction, whereby the hydraulic piston is attached to this bracket. It is hereby possible to obtain that the hydraulic piston is mainly perpendicular to the digging beam in the "zero" position of the digging beam. It is furthermore possible to locate the point of action at the opposite side of the pivot axle in relation to the digging beam, and it is also possible to use one or more hydraulic pistons or even a hydraulic motor, which cooperates with other driving members, such as rack gears, driving chains etcetera.

FIG. 6 shows in a perspective view from one side how the digging apparatus can be provided with supporting legs 22, which either can be detachable and easy to mount when the digging apparatus shall be detached from the loader on which it is attached or which supporting legs may be pivotably fitted to the structure on or adjacent the plate, thus that they can be folded up and locked along the digging beam when the apparatus is attached to a supporting machine.

Due to this compact design in which all parts and components are connected to the central plate, the digging apparatus according to the invention forms a device which fulfills the initially mentioned requirements in a simple and efficient manner.

The location of the hydraulic drive for the pivot movement above the pivot axle and the location of the vertical pivot axle at a distance from the plate, which however is so short that the stability will be large, means that a very big unhampered pivot movement is obtained. The stay bar 13 stabilizes the digging beam 11, which thereby can be of rather weak dimensions, at the same time as the stay bar allows adjustment of the working range of the apparatus, due to its adjustability. The location of the hydraulic piston far back entails that the power exerted by the hydraulic piston can be utilized very efficiently.

The invention is not limited to the embodiments shown in the accompanying drawings and described with reference thereto but modifications are possible within the scope of the accompanying claims.

I claim:

1. A digging apparatus applicable to a bucket loader, such as a tractor loader and of the type used for smaller digging work, such as in agriculture, park management or the like, and incorporating a connecting device intended to be interconnected to said bucket loader and with a pivot axle connected thereto and extending mainly perpendicularly to the extension of a digging beam, which is pivotably supported about the pivot axle and has an overhead stay bar, and a bucket attached to the free end thereof, which bucket is operable by means of a driving device, and having at least one hydraulic piston adapted to bring about the pivoting of the digging beam about the pivot axle and arranged to transfer pivot force to the digging beam at a short distance from the pivot axle, characterized thereby, that the digging beam and the stay bar are both designed as telescopic tubular profiles, which are individually adjustable in length by aid of individually operable attachment members in order easily to adapt the apparatus for attachment to different bucket loaders and for rapid adjustment of the geometry of the digging beam in relation to varying digging conditions and positions, wherein the digging beam is bent downwards at its outer end.

2. A digging apparatus applicable to a bucket loader, such as a tractor loader and of the type used for smaller digging work, such as in agriculture, park management or the like, and incorporating a connecting device intended to be interconnected to said bucket loader and with a pivot axle connected thereto and extending mainly perpendicularly to the extension of a digging beam, which is pivotably supported about the pivot axle and has an overhead stay bar, and a bucket attached to the free end thereof, which bucket is operable by means of a driving device, and having at least one hydraulic piston adapted to bring about the pivoting of the digging beam about the pivot axle and arranged to transfer pivot force to the digging beam at a short distance from the pivot axle, characterized thereby, that the digging beam and the stay bar are both designed as telescopic tubular profiles, which are individually adjustable in length by aid of individually operable attachment members in order easily to adapt the apparatus for attachment to different bucket loaders and for rapid adjustment of the geometry of the digging beam in relation to varying digging conditions and positions, wherein the pivot axle is arranged mainly vertical in the position of use and supports a pivotable bracket provided with mainly horizontal pivot axles for supporting the ends of digging beam and stay bar.

3. A digging apparatus applicable to a bucket loader, such as a tractor loader and of the type incorporating a connecting device, intended to be interconnected to said bucket loader and with a pivot axle connected thereto and extending substantially perpendicularly to the extension of a digging beam, a bracket pivotably supported about said pivot axle and having pivot axles about which are pivotably supported, and adjustable digging beam and an overhead stay bar respectively, a bucket attached to the free end thereof, which bucket is operable by means of a driving device, and at least one hydraulic piston pivoting the digging beam about the pivot axle and arranged to transfer pivot force to the digging beam at a short distance from the pivot axle, wherein the bracket pivot axles for the digging beam and stay bar are spaced apart above the other along an imagined line at a distance from and substantially parallel with the substantially vertically entending pivot axle, and that the digging beam and the stay bar are individually adjustable in length, for making possible a rapid adaption of the apparatus for fitting to different bucket loaders and for rapid adjustment of the geometry of the digging beam in relation to varying digging conditions and positions.

4. A digging apparatus according to claim 3 wherein the digging beam is bent downwards at its outer end.

* * * * *